United States Patent [19]

Selby

[11] Patent Number: 4,989,354

[45] Date of Patent: Feb. 5, 1991

[54] SPORTS OR TRADE EMBLEM

[76] Inventor: Jerry W. Selby, 3863 Sourek Rd. Ext., Akron, Ohio 44313

[21] Appl. No.: 334,334

[22] Filed: Apr. 7, 1989

[51] Int. Cl.[5] ..... A47G 1/06

[52] U.S. Cl. ..... 40/160; 40/540

[58] Field of Search ..... 40/160, 406, 427, 431, 40/442, 540, 554, 552

[56] References Cited

U.S. PATENT DOCUMENTS

| | | | |
|---|---|---|---|
| 1,543,424 | 6/1925 | Cowles | 40/540 X |
| 1,820,708 | 8/1931 | O'Neill | 40/540 |
| 2,178,634 | 11/1939 | Howenstine | 40/540 |
| 2,185,708 | 1/1940 | Meyerricks | 40/540 |
| 2,748,260 | 5/1956 | Nilson | 40/540 |
| 3,835,308 | 9/1974 | Reese | 40/540 X |

FOREIGN PATENT DOCUMENTS

| | | | |
|---|---|---|---|
| 544584 | 1/1956 | Italy | 40/540 |

*Primary Examiner*—Laurie K. Cranmer

*Attorney, Agent, or Firm*—Renner, Otto, Boisselle & Sklar

[57] ABSTRACT

A sports or trade symbol, emblem or sign is in the form of an enlarged three dimensional fabric covered frame, which emblazoned with the recognizable colors or name of a sports team or trade organization. In one preferred form the symbol is in the form of a sports headgear. The emblem may be supported over the top of a scoreboard, and may include a face. The emblem is formed by a frame of welded metal tubing and has transluscent fabric parts stretched thereover. The frame is preferably supported on a single center post and includes internal lighting fixture to illuminate the emblem to present an attractive team oriented sports display for night games. For a sports symbol including a face, special effects may be provided at the eyes, nostrils or mouth such as flashing lights or smoke emitters which may be activated when a team scores, or which may act as an oriflamme.

24 Claims, 4 Drawing Sheets

SPORTS OR TRADE EMBLEM

DISCLOSURE

This invention relates generally as indicated to a sports or trade emblem and more particularly to an enlarged outdoor illuminated emblem formed of transluscent fabric stretched over a light weight frame.

BACKGROUND OF THE INVENTION

Large three dimensional emblems are sometimes employed at sporting events, or in connection with a trade or business. Such symbols or emblems are heavy, and costly to construct and maintain.

Fabric covered outdoor canopies or awnings are widely employed for shade or protection at store fronts or entranceways and generally comprise fabric stretched over frames of relatively simple configuration. For maintenance the fabric can be cleaned, or replaced.

It would therefore be desirable if technology of awnings or simple canopies could be employed to construct a low cost, light weight, durable and easy to maintain outdoor sports or trade symbol or emblem. This would make available to a wide variety of sports complexes or trades an affordable sports, team or trade symbol. An example of such complexes would be high school or college football or other sports stadia.

SUMMARY OF THE INVENTION

A sports or trade symbol, emblem or sign is in the form of an enlarged three dimensional fabric covered frame, which emblem is emblazoned with the recognizable colors or name of a sports team or trade organization. In one preferred form the symbol is in the form of a sports headgear. The emblem may be supported over the top of a scoreboard, and may include a face. The emblem is formed by a frame of welded metal tubing and has transluscent fabric parts stretched thereover. The frame is preferably supported on a single center post and includes internal lighting fixtures to illuminate the emblem to present an attractive team oriented sports display for night games. For a sports symbol including a face, special effects may be provided at the eyes, nostrils or mouth such as flashing lights or smoke emitters which may be activated when a team scores, or which may act as an oriflamme.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
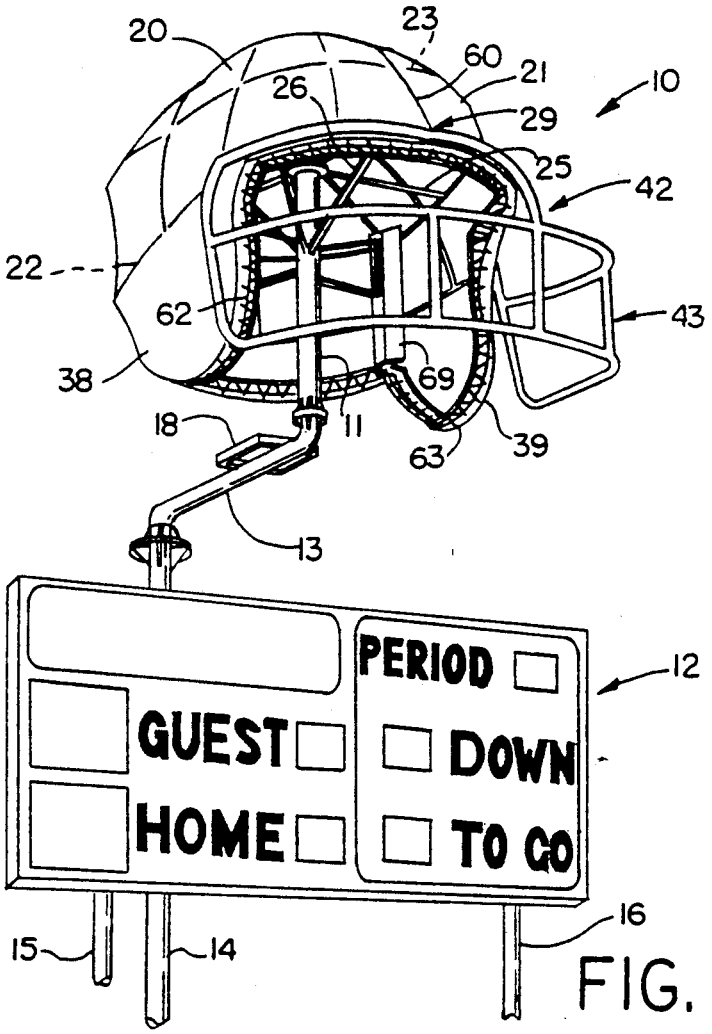
FIG. 1 is a perspective view of an emblem or symbol in accordance with the present invention shown mounted over a scoreboard.

Referring first to FIG. 1 there is illustrated a sports or trade emblem 10 in accordance with the present invention. The emblem is mounted on a single center post 11 which projects upwardly directly over a scoreboard shown generally at 12. The post 11 extends vertically from the outer end of a horizontal arm 13 which is mounted on top of post 14. The post 14 is anchored in the ground on a suitable footer as are the posts 15 and 16 for the scoreboard 12. In this manner the emblem 10 is supported in cantilever fashion over the top of the scoreboard.

As illustrated the emblem is in the form of a three dimensional object which is a football helmet and as illustrated the scoreboard is a football scoreboard. To provide a more clear idea of the size of the emblem it is noted that the outer end of the horizontal arm 13 is provided with a rigid platform 18 which enables someone to stand on the platform and extend up into the interior of the emblem to change the fluorescent tubes of the light fixtures hereinafter described or to otherwise service the emblem.

Figure 3:
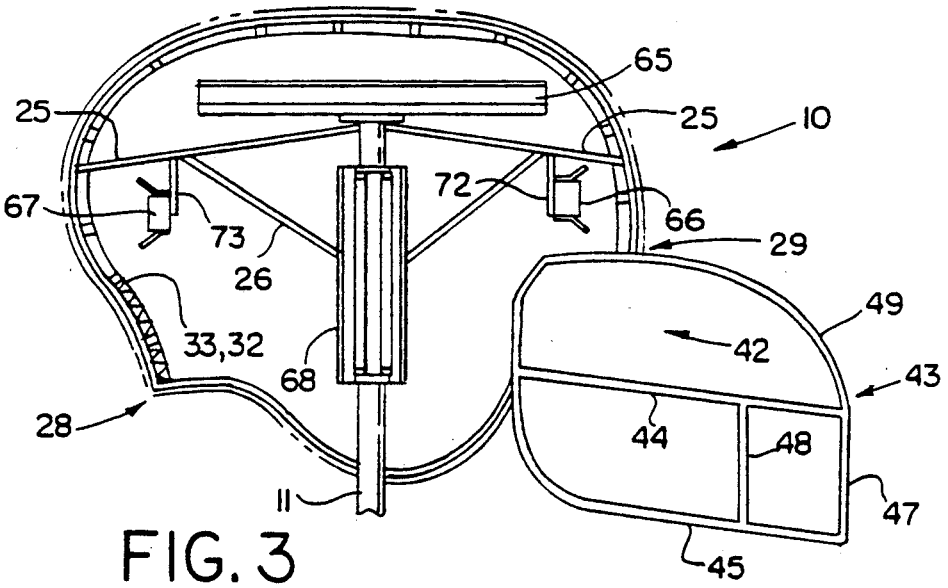
FIG. 3 is a side elevation with the fabric removed showing the arrangement of the light fixtures.
Figure 2:
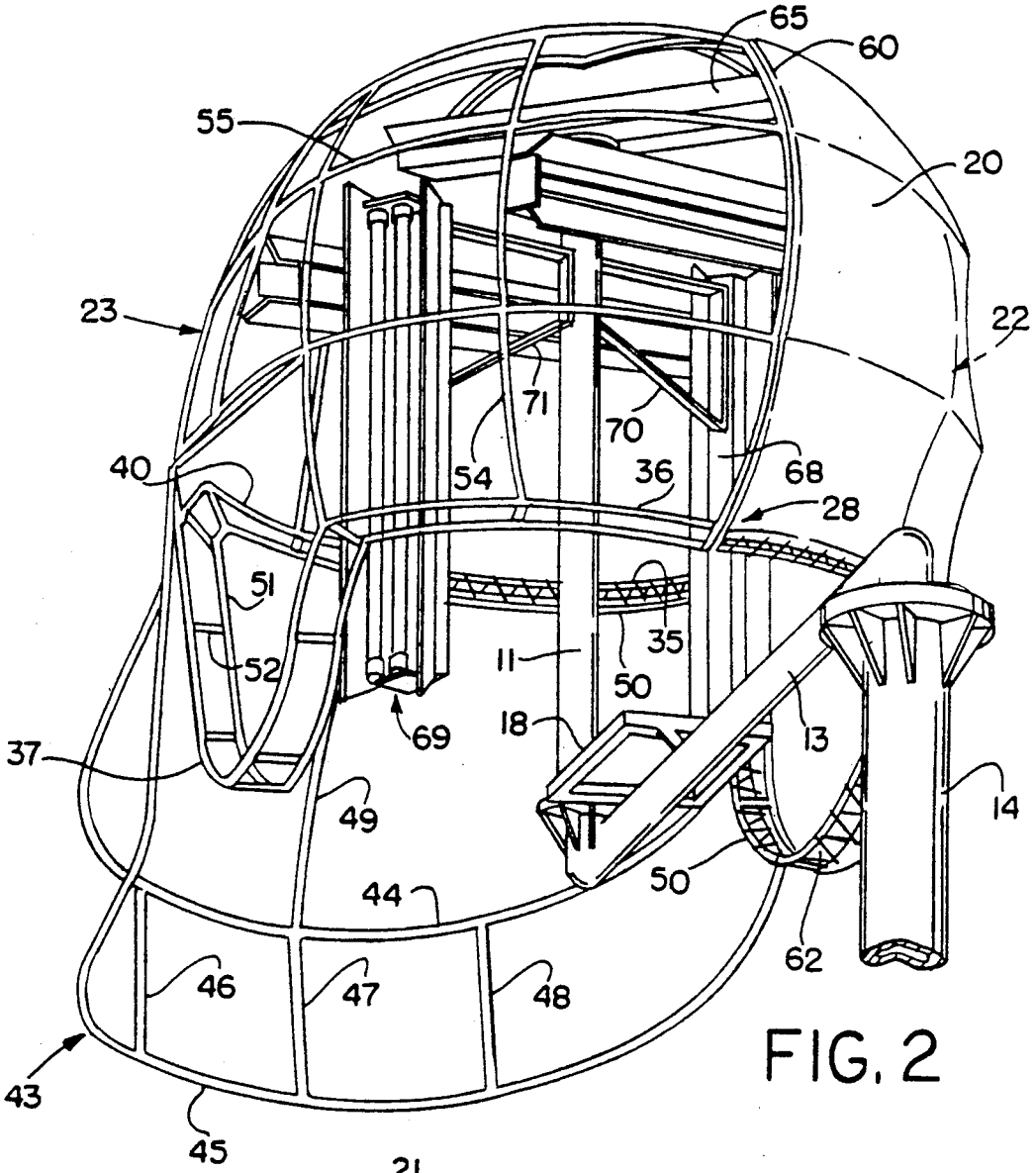
FIG. 2 is a perspective view from the rear of the emblem with part of the fabric removed.
Figure 4:
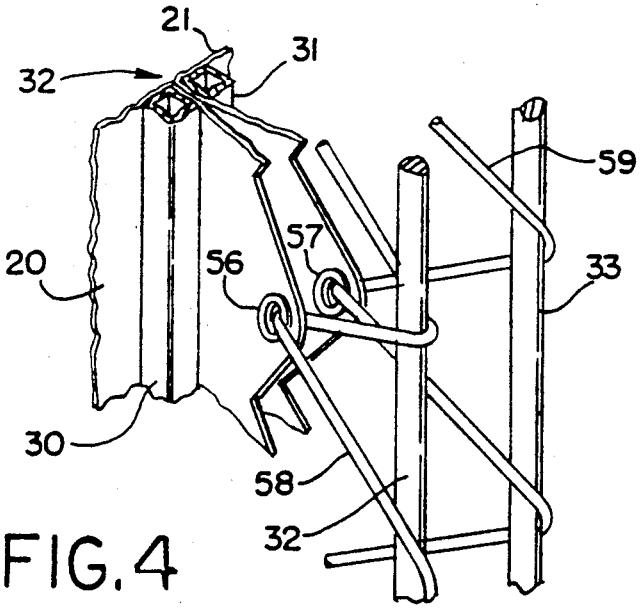
FIG. 4 is an enlarged fragmentary detail of the midplane seam which forms the two lateral sides of the helmet emblem illustrated.

Referring now additionally to FIGS. 2, 3 and 4 it will be seen that the emblem 10 is formed of two transluscent fabric covers 20 and 21 which are stretched over respective symmetrical frame portions 22 and 23. In FIG. 2 the fabric 21 is removed from the righthand side frame 23, viewed from the front of the emblem. Each frame is formed of welded square in section metal tubing and the two symmetrical frames are joined along the lower edge of the illustrated helmet. The frames are supported from the central post 11 by a plurality of struts 25 which are braced by struts 26.

As seen more clearly in FIG. 4 each frame part includes a frame member which extends from the back center of the emblem as indicated at 28 over the top of the emblem to terminate at the front center indicated at 29. These frame members are illustrated at 30 and 31 for the frames 22 and 23, respectively. Such frame members 30 and 31 are slightly spaced to form a slight gap as illustrated at 32 so that the edges of the respective fabrics 20 and 21 may be drawn through such gap at the vertical midplane of the emblem or at the crown of the helmet. Positioned radially inwardly from the respective crown frame members 30 and 31 are generally uniformly spaced respective tie rods seen at 32 and 33. The spacing of the tie rods 32 and 33 is somewhat greater than the spacing of the crown frame members 30 and 31.

As seen more clearly in FIG. 2 the crown frame members 30 and 31 terminate in lower edge frame members 35 and 36 which extend generally horizontally from the back of the helmet and then curve downwardly as indicated at 37 to form the respective ear flaps 38 and 39. From the ear flaps the edge frame members extend upwardly to a higher elevation indicated at 40 to extend horizontally to the point 29 to be joined again with the frame member passing over the crown of the helmet. In this manner there is formed an open face or front shown generally at 42 which may be covered by a face guard frame shown generally at 43. The face guard frame includes horizontally extending bowed frame members 44 and 45 which are vertically interconnected by the frame members 46, 47 and 48, with the middle frame member 47 extending to the center of the top front edge of the helmet or the point 29 as indicated at 49. The frame 43 is connected to both sides of the helmet and also to the top at the front to simulate a football helmet face guard.

Spaced horizontally uniformly inwardly from the lower edge frame members 35 and 36 are tie rods 50 and 51 which are similar to the tie rods 32 and 33 and like such tie rods are spaced inwardly from the edge struts by relatively short struts shown generally at 52. Each frame part includes longitudinal frame members shown at 54 and latitudinal frame members such as seen at 55 which form the two frames into generally spherical complementing helmet halves.

The respective transluscent fabric parts 20 and 21 are tailored to fit such helmet halves and as seen in FIG. 4 the edges are provided with peripherally uniformly spaced eyelets seen at 56 and 57 which permit the fabric edges to be drawn tightly over the frame by the lacing seen at 58 and 59, respectively. Such lacing extends through the eyelets and is drawn around the tie bars to tension the fabric. As illustrated in FIG. 4 the fabric edges of the two fabric parts are drawn through the relatively narrow gap 32 between the frame members 30 and 31 which forms a seam 60 extending over the crown of the helmet. Lacing is similarly employed to draw the fabric parts taut around the lower edge frame members, such lacing being shown at 62 and 63 for the respective fabric parts 20 and 21. In this manner the fabric parts may be drawn taut to provide a smooth transluscent surface which may be decorated by the insignia or color of a particular football team in the same manner as the helmets the players wear.

As seen in FIGS. 1, 2 and 3, there is provided a number of interior fluorescent lighting fixtures so that the helmet may be illuminated. More particularly, there is provided an upwardly directed horizontal lighting fixture 65 on top of the post. There is also provided front and rear horizontal lighting fixtures 66 and 67, and at each side of the helmet vertically extending lighting fixtures are provided as seen at 68 and 69. The fixtures 68 and 69 may be supported in such vertical position by frames 70 and 71 extending from near the top of the post. The fixtures 66 and 67 may be supported by brackets 72 and 73 extending downwardly from the frame struts 25 as seen in FIG. 3, while the fixture 65 is simply supported on top of the post 11.

Referring now to FIGS. 5–8 there is illustrated an embodiment of the present invention which may include a facsimile of a face which is shown generally at 76. The face may be formed by a separate transluscent fabric 77 drawn over a frame which spans the generally open front 42 of the helmet. The frame may include a lower arched transverse member 80, an intermediate arched member 81 and a middle arched member 82. The lower arched member 80 forms the bottom of the face while the arched member 81 may form a chin line seen generally at 83 in FIGS. 5 and 6. The middle arched member may include a central frame providing an interior support configuration for the nose 84. The arched members 80 and 81 may be secured to each side of the helmet by rigid bars indicated at 86 in FIG. 7 while the mid frame member 82 is supported at each end by bars 87.

Extending horizontally inwardly and slightly upwardly and uniformly spaced from the bottom frame member 80 is a tie rod 89 so that the bottom of the face fabric 77 may be stretched over the front edge of the bottom frame member 80 and laced back tightly along the bottom edge by the lacing seen at 90.

Figure 8:
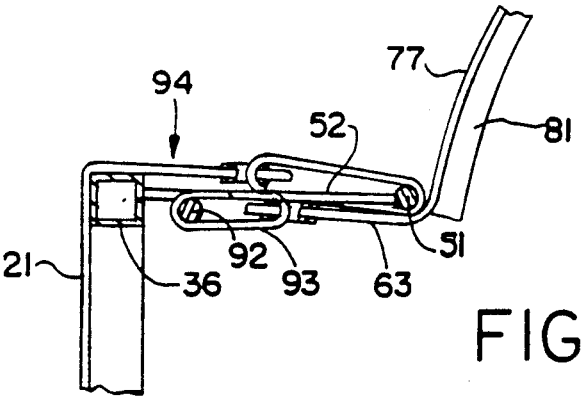
FIG. 8 is an enlarged fragmentary section taken substantially from the line 8—8 of FIG. 7 showing the detail of the helmet-face connection.

Along the edges and top of the open front of the helmet the fabric 77 is drawn over the tie rods 50 and 51 and secured to further tie rod 92 by the lacing indicated at 93. The tie rod 92 is secured inwardly spaced from the tie rod 51 and may be welded to the short struts 52 supporting the tie rod 51. As seen in FIG. 8 the tie rod 92 is obscured by the edge of the fabric drawn around the edge frame 36 as indicated by the arrow 94 from the front of the emblem.

Figure 5:
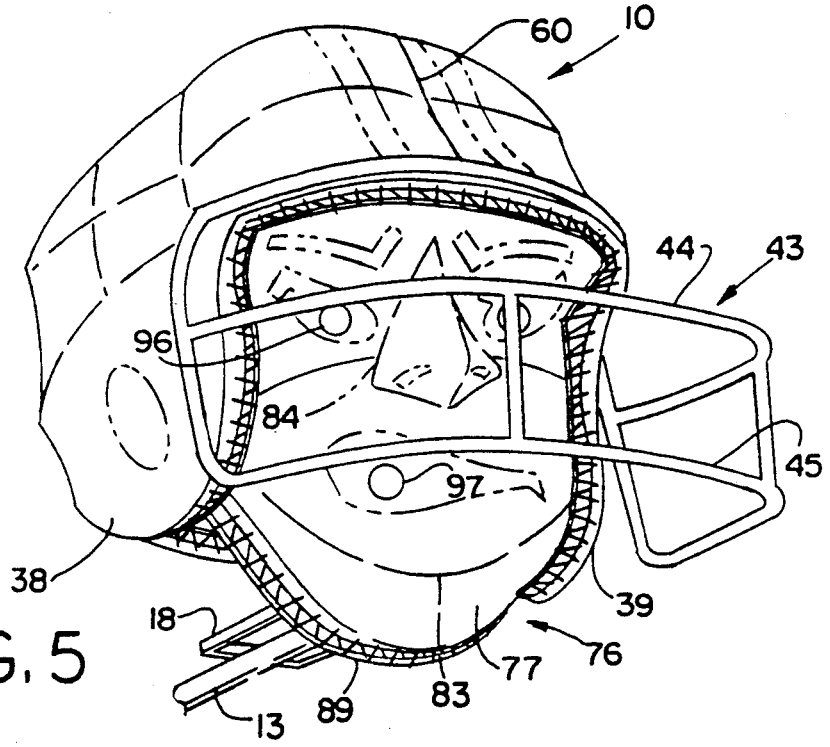
FIG. 5 is a front perspective view of an embodiment which includes a face.
Figure 6:
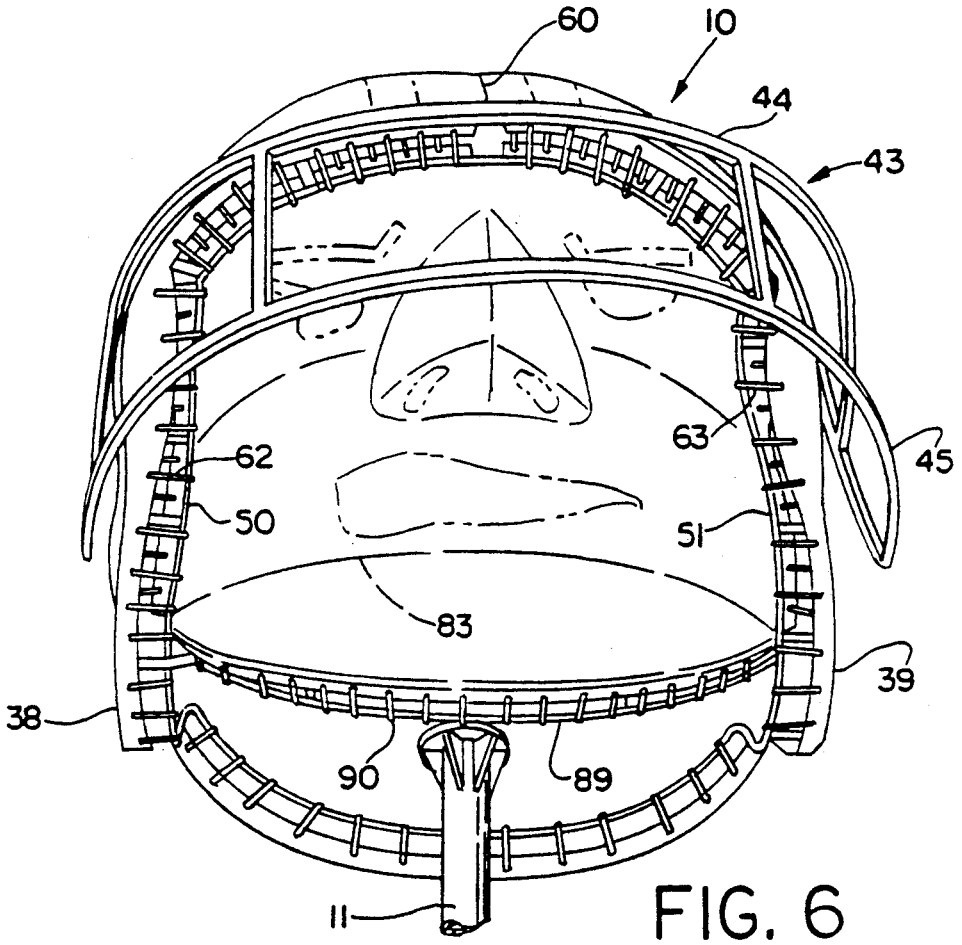
FIG. 6 is a more frontal perspective view of the embodiment of FIG. 5.
Figure 7:
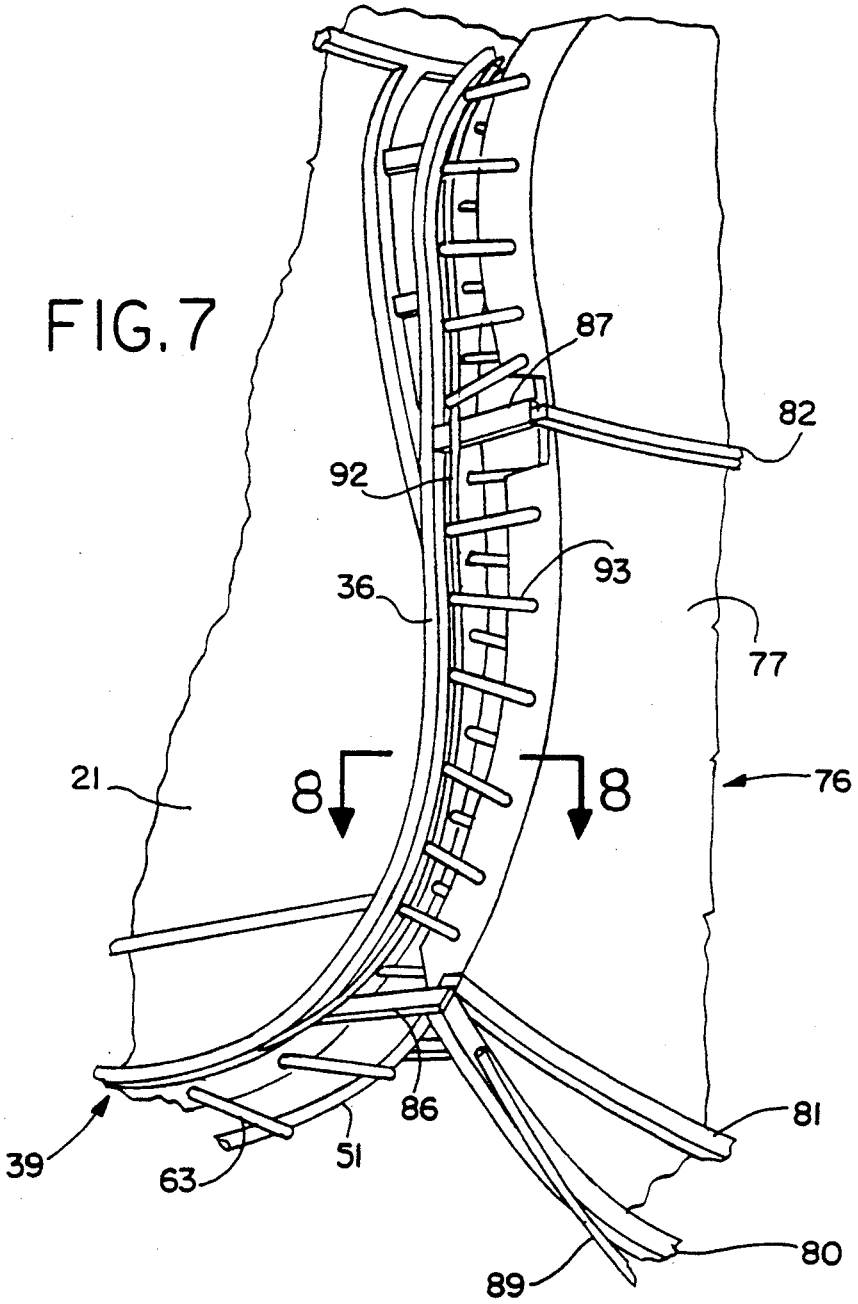
FIG. 7 is an enlarged fragmentary perspective detail of the area between the face and helmet parts taken from the interior.

Reverting to FIG. 5 it will be seen that the fabric 77 forming the face is provided with the facsimile of a face and at the eyes, nostrils or mouth, special effects devices may be mounted as indicated at 96 and 97. At the eyes, the devices 96 may comprise revolving or flashing lights while at the nostrils or mouth the devices may comprise smoke emitters. Thus, when a team such as a home team scores, the special effects devices may be actuated in celebration of a score. Such special effects devices may also be utilized in connection with a pep rally or as an oriflamme.

While the illustrated embodiments depict a sports headgear such as a football helmet, it will be appreciated that other three dimensional objects may similarly be formed as a sports or trade symbol or emblem. For example, a baseball cap or helmet may be formed or a hockey mask and helmet. The three dimensional form may also be something similar to a golf bag for a golf tournament, a bowling pin for a bowling tournament, a soccer ball or a basket ball or even a tennis ball to be displayed at a game or tournament. The transluscent fabric may include a color design which is the insignia of a team or it may simply include a name or phrase.

It can now be seen that there is provided a low cost, large insignia, emblem or symbol which can be illuminated and which can be maintained as any awning.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A sports or trade emblem and the like comprising an enlarged frame having edges and being in the shape of a recognizable three dimensional object, a fabric stretched over said frame to form the shape of such object, said fabric being provided with a color pattern or name to enhance further the recognition of such object, stretcher elements positioned in the interior of said frame, and securing means for drawing the fabric around the edges of the frame at an angle and for securing the edges of said fabric to said stretcher elements.

2. An emblem as set forth in claim 1 wherein said fabric is transluscent, and interior lighting to illuminate the emblem.

3. An emblem as set forth in claim 1 wherein said frame includes two adjacent halves, each having a separate fabric stretched thereover.

4. An emblem as set forth in claim 1 wherein said frame includes two adjacent quarter spherical halves adjacent each other and forming a front to back seam along the top of the emblem.

5. A sprots or trade emblem and the like comprising an enlarged frame in the shape of a recognizable three dimensional object and including two adjacent quarter spherical halves adjacent each other and forming a front to back seam along the top of the emblem said halves having lower edges, a fabric stretched over said frame to form the shape of such object, said fabric being provided with a color pattern or name to enhance further the recognition of such object, and stretcher rods secured to the periphery of each frame half, the stretcher rods being spaced radially downwardly along said front to back seam and radially inwardly along the lower edges, and lacing wrapped around said stretcher rods to draw the fabric tight over the exterior of said frame halves.

6. A sports or trade emblem and the like comprising an enlarged frame in the shape of a recognizable three dimensional object and including two adjacent quarter spherical havles adjacent each other and forming a front to back seam along the top of the emblem, a fabric stretched over said frame to form the shape of such object, said fabric being provided with a color pattern or name to enhance further the recognition of such object, and wherein the edges of said frame halves are provided with slightly inwardly spaced stretcher rods, and lacing wrapped around said stretcher rods to draw the fabric around the edge of the frames at a substantially 90° angle.

7. An emblem as set forth in claim 6 wherein the stretcher rods along the front to back seam are slightly spaced from each other to enable lacing to be wrapped therearound.

8. An emblem as set forth in claim 1 wherein said object is a sports headgear including a color pattern to simulate the headgear design of a sports team.

9. An emblem as set forth in claim 8 wherein said fabric is transluscent, and interior lighting to illuminate the emblem.

10. An emblem as set forth in claim 9 wherein said emblem is mounted on a single vertical post.

11. An emblem as set forth in claim 10 including fluorescent lighting fixtures mounted on said post on the interior of said emblem.

12. An emblem as set forth in claim 8 wherein said headgear includes an open front, and a frame across such open front with a fabric stretched thereover including a facsimile of a face.

13. An emblem as set forth in claim 12 including special effect means at the eyes, nostrils or mouth of such face.

14. A three dimensional emblem comprising separate frames, separate fabrics covering the exterior of said frames, coextensive frame members on each frame closely adjacent yet slightly gap spaced from each other, said frame members each including tie rods generally uniformly upwardly spaced therefrom whereby said separate fabrics may be stretched over the exterior of each frame and drawn through the slight gap spacing between said coextensive frame members to be secured to the respective tie rod.

15. An emblem as set forth in claim 14 wherein said separate frame parts each forms a curved surface complementing the surface of the other.

16. An emblem as set forth in claim 15 wherein said coextensive frame members and the gap therebetween are along a vertical midplane of the emblem.

17. An emblem as set forth in claim 16 wherein each of said separate frames includes longitudinal and latitudinal struts forming a generally spherical surface support for the respective fabrics.

18. An emblem as set forth in claim 14 wherein said separate frames are supported from a single central post.

19. An emblem as set forth in claim 18 including lighting fixtures mounted on said post in the interior of said emblem to illuminate the same.

20. An emblem as set forth in claim 14 wherein said emblem is in the form of sports headgear having an open front.

21. An emblem as set forth in claim 20 wherein said frames include a further frame spanning said open front, said further frame including a lower member forming a chin line, and a further fabric covering stretched over said further frame including a facsimile of a face.

22. An emblem as set forth in claim 21 wherein said emblem separate frames include a lower edge frame member forming the lower edge of such sports headgear and such open front, and edge tie rods generally uniformly inwardly spaced from said lower edge forming frame members whereby the lower edges of said separate fabrics may be stretched over the lower edge of said separate frames and along the edge of the open front.

23. An emblem as set forth in claim 22 including a second tie rod positioned between said edge tie rod and the edge of said emblem at such open front whereby such further fabric forming the face may be stretched around said first mentioned edge tie rod at such open front and secured to the second tie rod.

24. An emblem as set forth in claim 23 wherein said further frame includes special effect means at the eyes, nose or mouth of said further fabric.

* * * * *